United States Patent [19]

Gritskov et al.

[11] 4,032,273

[45] June 28, 1977

[54] APPARATUS FOR SPINNING ARTIFICIAL FILAMENT

[76] Inventors: Ivan Viktorovich Gritskov, ulitsa Sverdlova, 10, kv. 2; Pavel Anatolievich Butyagin, ulitsa Sovetskaya, 39/1, kv. 6, both of Cherkassy; Ivan Gavrilovich Shimko, ulitsa Rudnevoi, 4/13, kv. 24, Moscow; Evsei Moiseevich Mogilevsky, Kutuzovsky prospekt, 17, kv. 9, Moscow; Igor Petrovich Baksheev, proezd Shokalskogo, 153, kv. 140, Moscow; Georgy Georgievich Finger, ulitsa Matveevskaya, 4, korpus 2, kv. 21, Moscow; Ljudmila Sergeevna Scherbakova, prospekt Kosmonavtov, 27, korpus 2, kv. 104, Leningrad; Nina Timofeevna Butkova, ulitsa Sovetskaya, 39/1, kv. 6, Cherkassy; Lev Grigorievich Kaller, ulitsa Krasilovskaya, 5/2, kv. 10, Kiev, all of U.S.S.R.

[22] Filed: Jan. 22, 1976

[21] Appl. No.: 651,246

[52] U.S. Cl. ..... 425/67; 425/68

[51] Int. Cl.² ..... D01D 3/00; D01D 5/06

[58] Field of Search ..... 425/67, 68

[56] References Cited

UNITED STATES PATENTS 2,057,411 10/1936 Bitter ..... 425/68 X

FOREIGN PATENTS OR APPLICATIONS 135,639 12/1949 Australia ..... 425/68

*Primary Examiner*—Robert D. Baldwin

*Attorney, Agent, or Firm*—Steinberg & Blake

[57] ABSTRACT

An apparatus for spinning artificial filaments relates to continuous spinning frames. It comprises a reservoir with spinning solution containin a spinneret and a portion of one cylinder of a pair where complete recovery of the filament takes place. A partition dividing the reservoir into a complete recovery zone and a filament spinning zone is located in the reservoir between the spinneret and that portion of cylinder which is dipped into the spinning solution, said partition filtering the spinning solution flowing from the complete recovery zone to the spinning zone. A collector for feeding the spinning solution is mounted in the complete recovery zone, whereas a collector for discharging the spinning solution is mounted in the spinning zone. This makes it possible to reduce substantially amount of the spinning solution circulating within the apparatus and to separate from the solution elementary sulphur.

5 Claims, 3 Drawing Figures

APPARATUS FOR SPINNING ARTIFICIAL FILAMENT

This invention relates to continuous spinning apparatus for chemical filaments and more particularly to spinning frames for artificial filaments such as viscose filaments treated on these frames.

Known in the art are apparatus for spinning artificial filaments, wherein freshly spun filaments are subjected to complete recovery in the course of their forwarding under the action of the amount of the spinning solution which is carried away from the spinning zone by the filament itself.

Furthermore, the process of the complete recovery may be also performed by spraying the filament with the spinning solution or by treating it with the same solution in tubes or troughs.

In the above process the temperature of the solution used for complete recovery of filaments is generally lower than that of the spinning solution used to spin the filaments thereby leading to decreasing the rate of complete recovery of the filament and hence to limiting the spinning speed.

In addition, known in the art is an apparatus for spinning artificial filaments comprising a spinneret accommodated in a spinning bath, a pair of cylinders forwarding a freshly spun filament and an additional spinning bath containing collectors for feeding and discharging the spinning solution and that portion of one of the cylinders of said pair which is dipped into the solution.

In the above apparatus the cylinders of the pair are offset with respect to each other so as geometrical axes thereof are intersected thereby ensuring uniform distribution of filament turns over the cylinder surface. It should be also noted that the solution containing the portion of one of the cylinders of said pair has a temperature (68°–70°) which is higher than that of the spinning solution (50°–55°). Though this temperature difference contributes to the quality of the finished filament to a great extent and makes it possible to increase the efficiency of the spinning apparatus, it complicates the structure of the apparatus taking into account the necessity to provide for a separate system of collectors used to feed the spinning solution completely recovering the filament, and special materials for the manufacture of reservoirs which are resistant to the action of high temperature spinning solution. It should be also noted in this respect that the above-described system complicates the maintenance of the apparatus. The complete recovery of the filament in a separate reservoir leads to a considerable consumption of the solution with the resulted liberation of elementary sulphur in great amount, this sulphur settling on the surface of thread guides and manifolds.

An object of the present invention is to eliminate the above disadvantages.

Another object of the present invention is to provide an apparatus for spinning artificial filaments which makes it possible to use the same spinning solution both for spinning and for complete recovery of the filaments, while maintaining high quality of the finished product which makes it possible to save to a great extent the amount of the spinning solution used for making these filaments and to simplify both the structure and the maintenance of the machine as a whole.

In accordance with the above and other objects, in an apparatus for spinning artificial filaments comprising a spinneret, a pair of cylinders adapted to forward the filament, a reservoir accommodating collectors for feeding and discharging the spinning solution and a portion of one of said cylinders of said pair, said portion being dipped into the spinning solution, according to the invention, the spinneret is mounted in said reservoir, wherein a partition permeable for the spinning solution is mounted between the spinneret and the dipped portion of the cylinder, said partition dividing the reservoir into a filament spinning zone and a zone for complete recovery of the filament, said partition filtering the portion of the spinning solution passing from the complete recovery zone to the spinning zone. A collector for feeding the spinning solution being mounted within the complete recovery zone, whereas a collector for discharging the spinning solution is located within the spinning zone.

Furthermore, the invention is characterized in that substantially vertical guides are mounted within he reservoir, said guides comprising a filtering partition which makes it possible to remove this partition from the reservoir, and to replace it with another one, when required.

Another characteristic feature of the invention lies in the fact that the partition is made of a material resistant to the action of the spinning solution, thereby ensuring prolonged and repeated usage thereof.

Still another feature of the invention consists in that a discharging collector for the spinning solution is mounted between the wall of the reservoir and the spinneret, whereas a feeding collector for the solution is mounted between the wall of the reservoir and that portion of the cylinder which is dipped into the spinning solution.

Thus, in the apparatus of the present invention a single reservoir and one and the same spinning solution are used both for spinning and for complete recovery of the filament. This makes it possible to reduce considerably the total amount of circulating spinning solution from 100 to 60 litres per one spinneret per hour. This reduction of the circulating solution provides for not only the decrease of heat emission from the solution into a space below a capsule thus improving operation conditions but, which is more important, this reduces the amount of contaminations contacting the filament being spun, these contaminations being present in the solution in the form of polyvalent metals actively absorbed by the filament.

Given below is a table presenting experimental data concerning the amount of iron in the filament depending on its content in the solution and the amount of the circulating solution in the reservoir.

| Iron content in solution,g/liter | Amount of spinning solution treating the filament, liter per one spinneret | Iron content filament, mg/kg |
|---|---|---|
| 10 | 60 | 5.2 |
| 10 | 100 | 7.4 |
| 50 | 60 | 8.9 |
| 50 | 100 | 14.1 |

As it follows from the table above, more intensive circulation of the spinning solution markedly affects iron content in the filament and hence it quality.

The partition in the reservoir performs filtration of the solution directly in the zone of extraction of elementary sulphur from the sulphur-containing by-product of the viscose solution. The most intensive extraction of the sulphur just separated from the filament body takes place during the initial 10-12 seconds of the process of its complete recovery. Entrainment by the partition of elementary sulphur extracted into the solution prevents its accummulation in the solution and its settling onto the surface of the filament being spun which is favourable from the quality point of view, as the presence of the sulphur on the surface of the filament adversely affects the processing of the filament due to settling of the sulphur on the threadguides. It should be also noted that the settling of the elementary sulphur on the partition ensures more uniform circulation of the solution through the pipelines taking into account the considerable difficulties in conventional systems for filtering spinning solutions at an acid station, said station being generally mounted at a pronounced distance from the point where the extraction of elementary sulphur takes place. These difficulties are associated with the use of different surface-active agents as additives to the solution. For example, with the presence of anion-active agents such as leuconol an intensive dispergation of sulphur particles takes place, these particles being not subjected to controlled filtration on the filters. On the other part, with the use of cation-active agents as laurylpiridinesulphite, aggregation of sulphur particles takes place, this aggregation leading to settling of said particles within pipelines and other parts of equipment, as well as to nonuniform circulation of the solution.

Thus, the provision of the partition within the reservoir not only simplifies the structure of the apparatus but also reduces amount of the required spinning solution.

These and other characteristics of the invention will be more fully understood from the description of an apparatus for spinning artificial filaments, made according to the invention, with reference to accompanying drawings, wherein.

Figure 1:
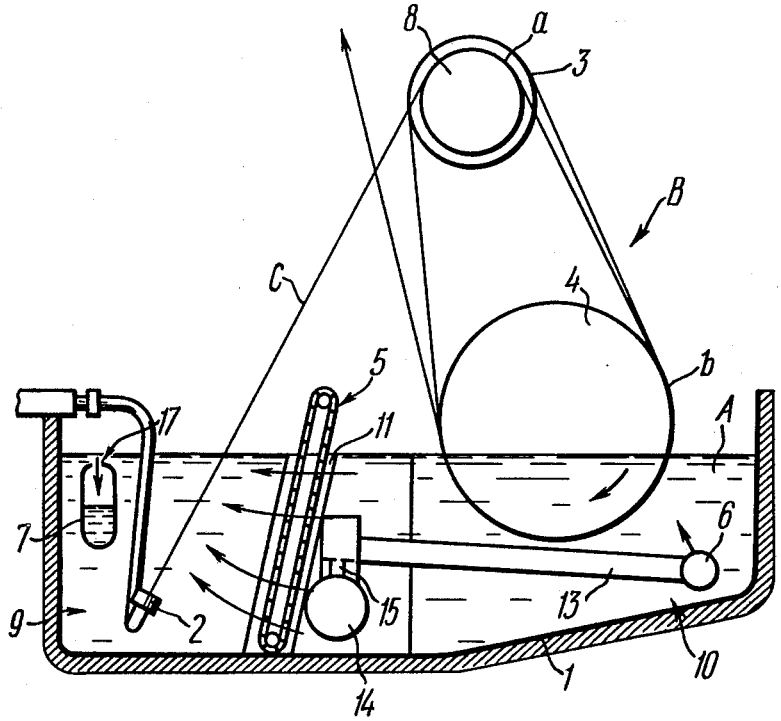
FIG. 1 is a schematic cross-sectional general view of an apparatus for spinning artificial filaments.

A device for spinning artificial filaments such as viscose filaments comprises a reservoir 1 (FIG. 1 and 2) containing spinning solution A, spinnerets 2, pairs B of rotating cylinders 3 and 4 forming a filament-forwarding means and adapted to forward the filaments, a partition 5 which is permeable for the spinning solution, a supply collector 6 for feeding the spinning solution to the reservoir 1, and a discharge collector 7 for discharging the spinning solution.

The spinnerets 2 are mounted within the reservoir 1 and submerged completely in the spinning solution A, as shown in FIG. 1, whereas a cylinder 4 of the pair B is only partially submerged in the solution of the same reservoir.

The cylinders 3 and 4 of the pair B are mounted in conventional manner one above another so that the geometrical axes thereof intersect in space (in order not to complicate the drawings and taking into account that such an arrangement of the cylinders is well known, they are not shown in the drawings). An end face of the cylinder 3 is provided with a head 8 (FIG. 3) accepting a freshly spun filament C. As shown in FIG. 1, the diameter of the cylinder 4 is greater than that of the cylinder 3.

The partition 5 is disposed within the reservoir 1 between the spinneret 2 and the portion of the cylinder 4 submerged in the spinning solution. This partition provides for the filtration of the spinning solution and divides the reservoir 1 into two zones 9 and 10 respectively with the zone 9 being used as a spinning zone as it contains the spinnerets 2, whereas the zone 10 is used as a complete recovery zone as it contains the portion of the cylinder 4 of the pair B where the complete recovery of the filament takes place.

The partition 5 is formed by a frame of any required design which is covered with a fabric resistant to the action of such media as acid and spinning solution both at normal or high temperature. The fabric may be made of such materials as polyvinylchloride, teflon, etc. The partition may also be made of solid material with openings (not shown) covered with a fabric and arranged at different heights of the partition.

Figure 3:
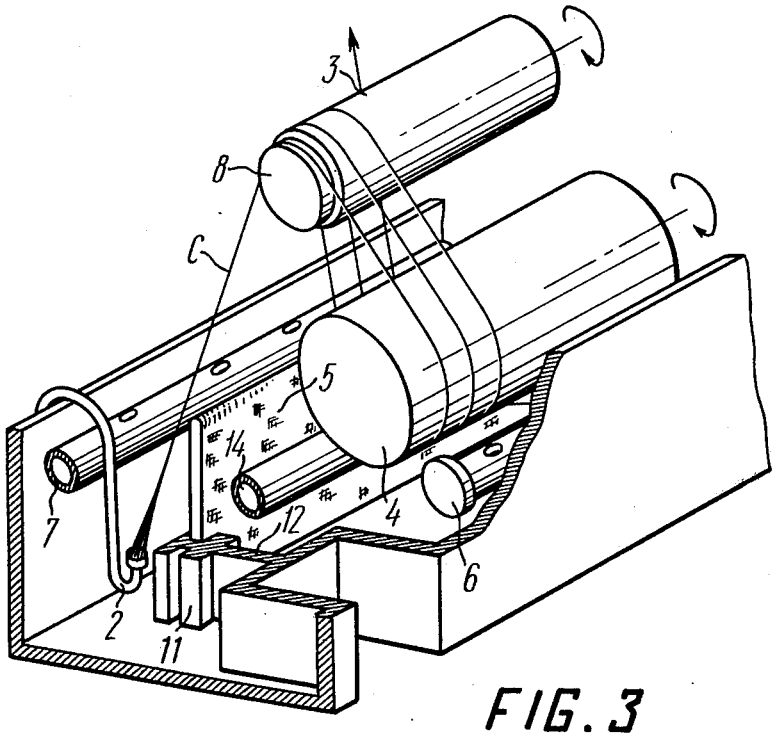
FIG. 3 is a partly cut-away perspective view of the apparatus of FIG. 1.

The partition may be arranged within the reservoir either vertically, as shown in FIG. 3, or slightly inclined, as shown in FIG. 1. Guides 11 are provided within the reservoir to fix the partition in a required position, the partition being inserted into said guides with its ends. Such a fixation of the partition ensures quick change thereof. For this purpose it is sufficient to shift the partition upwards along the guides and install a new one in the same manner.

Figure 2:
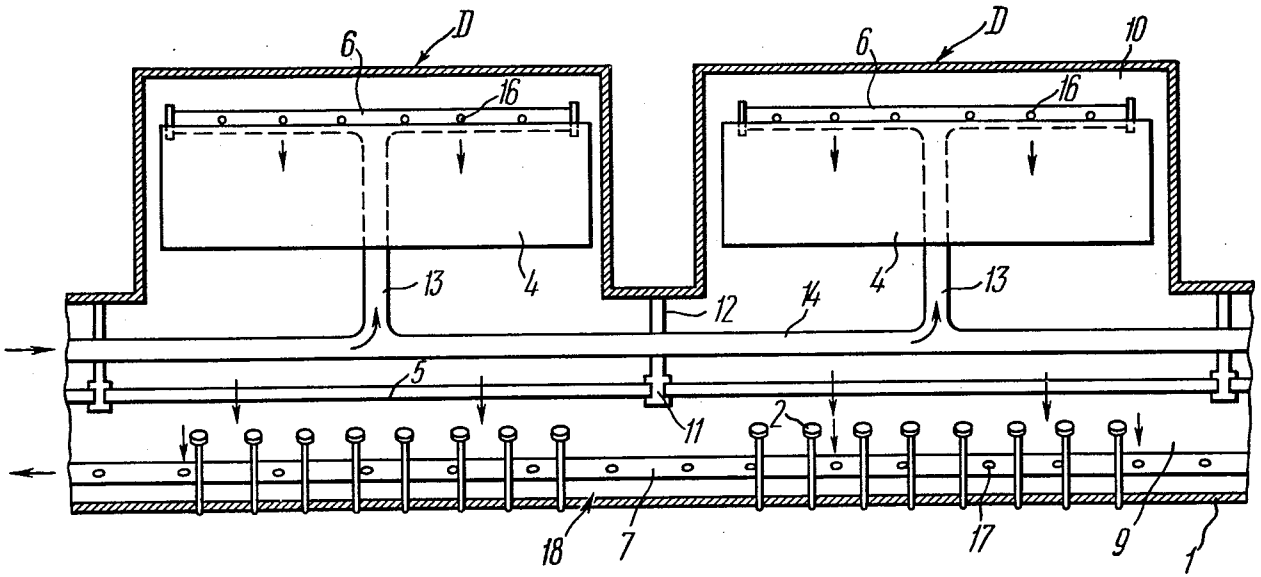
FIG. 2 is a plan view of the apparatus of FIG. 1, an upper cylinder being omitted.

The guides 11 are mounted both at the ends of the reservoir and on brackets 12 (FIG. 2 and 3).

The collector 6 for feeding the spinning solution is disposed within the complete recovery zone 10. This collector is spaced from the partition 5 and mounted between the reservoir wall and the portion of the cylinder 4 which is submerged in the spinning solution.

Since in continuous spinning frames for artificial filaments the spinning head is composed of a plurality of sections D each comprising a pair B of the cylinders 3 and 4 and a group of the spinnerets 2, the collector 6 in each section D is mounted in a manner described above and connected by a pipe union 13 to a manifold 14 common for all the sections and provided with calibrated openings 15 (FIG. 1) ensuring accurate metering of the solution fed to each section D of the apparatus. Equally spaced openings 16 (FIG. 2) are provided along the length of the collector 6, said openings ensuring uniform supply of the spinning solution into the space under the cylinder 4 along the whole length thereof. In order to simplify assemblying of the apparatus, the common distributing collector 14 is mounted in the complete recovery zone 10 and passes through all the sections D.

The collector 7 is mounted within the spinning zone 9 (FIG. 1). Its purpose is to discharge the spinning solution from a part of the reservoir 1 which is remote from the partition 5 and located between the reservoir wall and the spinnerets 2, as shwon in FIG. 1. Openings 17 are provided in the collector 7. Referring to FIG. 2, all the spinning zones 9 in the continuous spinning frame are collected into a common section 18 to provide for the most favourable operation conditions.

The apparatus operates in the following manner.

A viscose flow is extruded from the spinneret 2 (FIG. 1) and fed to the spinning zone 9 where under the action of acid salt spinning solution A it turns into a filament C. The freshly spun filament C is fed to the head 8 of the cylinder 3, turns around it and passes to the lower cylinder 4. Depending on the ratio of the diameters of the cylindrical head 8 and cylinder 4, the filament is stretched by 16–18% within the limits of portion "*a–b*". Due to intersection of the axes of the cylinders 3 and 4 of the pair B, the filament is helically laid over the cylinder along its length making sixteen-twenty two turns in total, said turns embracing both cylinders. Then the filament is forwarded for the subsequent operations. In doing so, the filament C is repeatedly dipped into the spinning solution within the zone 10 until complete recovery.

The spinning solution is continuously fed from the openings 16 of the collector 6 into the reservoir 1 in the course of spinning operation. Then the solution passes through the partition and is discharged through the collector 7. The above described circulation of the spinning solution makes it possible to increase its temperature in the complete recovery zone 10 as the supply of fresh solution is carried out near the cylinder 4. Due to intensive agitation of the solution under the action of the cylinder 4, the temperature of the solution in the reservoir section decreases with the result that in the spinning zone 9 it becomes 2° – 3° C lower as compared to the temperature in the zone 10. This decrease of temperature depends on the amount of the solution being fed and on the rotational speed of the cylinder 4. The decreased temperature in the spinning zone 9 is required to ensure more stable conditions for converting a viscose flow into a filament. Thus, the partition 5 ensures the conditions which are necessary to provide for more stable spinning conditions at the spinneret and, at the same time, to damp turbulent flows induced from the rotation of the cylinder 4.

Furthermore, the partition 5 separates the spinning solution from the sulphur subject to accummulation in the complete recovery zone 10 since elementary sulphur is usually extracted into the solution in the process of complete recovery of the filament in acid salt solutions of high temperature, said sulphur settling down on the surface of the partition and could not penetrate into the spinning zone 9.

After an excessive amount of the sulphur having been accummulated on the partion 5 the latter is removed and replaced by a new one.

We claim:

1. An apparatus for spinning artificial filaments comprising: a reservoir for spinning solution; a spinneret; filament-forwarding means for forwarding a filament, said filament-forwarding means being arranged with respect to said reservoir for forwarding a filament along a path part of which is submerged in the spinning solution; a partition mounted in said reservoir between the spinneret and said part of said path, said partition being permeable for the spinning solution and dividing the reservoir into a spinning zone and a complete recovery zone, said partition filtering the spinning solution during passing thereof from the complete recovery zone to the spinning zone, the spinneret being mounted in the spinning zone, whereas said part of said path is located in the complete recovery zone, whereby the filaments forwarded by said forwarding means are subjected to complete recovery; a supply collector for feeding the spinning solution into said reservoir, said supply collector being mounted in the complete recovery zone; and a discharge collector for discharging the spinning solution passing from the complete recovery zone through said partition into the spinning zone, said discharge collector being arranged in the spinning zone.

2. An apparatus according to claim 1, wherein substantially vertical guides are arranged in the reservoir, said guides positioning said partition.

3. An apparatus according to claim 1, wherein the partition is made of a material resistant to the action of the spinning solution.

4. An apparatus according to claim 1 wherein the reservoir has a pair of opposed walls, said discharge collector for discharging the spinning solution being installed between one of said reservoir walls and the spinneret, whereas the supply collector for feeding the spinning solution is mounted between the other of said reservoir walls and said part of said path.

5. An apparatus according to claim 1, wherein said filament-forwarding means includes a pair of rotary cylinders one of which is partially submerged in the spinning solution for forwarding the filament along said part of said path.

* * * * *